US009415286B2

(12) United States Patent
Lovelace et al.

(10) Patent No.: US 9,415,286 B2
(45) Date of Patent: Aug. 16, 2016

(54) TRAINING DEVICE

(71) Applicant: Brothers Innovative Solutions, LLC, Palm City, FL (US)

(72) Inventors: Jay H. Lovelace, Palm City, FL (US); Daniel J. DiPace, Palm City, FL (US)

(73) Assignee: Brothers Innovative Solutions, LLC, Palm City, FL (US)

( * ) Notice: Subject to any disclaimer, the term of this patent is extended or adjusted under 35 U.S.C. 154(b) by 0 days.

(21) Appl. No.: 14/326,956

(22) Filed: Jul. 9, 2014

(65) Prior Publication Data

US 2015/0018132 A1 Jan. 15, 2015

Related U.S. Application Data

(60) Provisional application No. 61/844,093, filed on Jul. 9, 2013, provisional application No. 61/885,846, filed on Oct. 2, 2013.

(51) Int. Cl.

| | |
|---|---|
| ***A63B 69/00*** | (2006.01) |
| ***A63B 15/00*** | (2006.01) |
| ***A63B 21/02*** | (2006.01) |
| ***A63B 23/035*** | (2006.01) |
| ***A63B 21/00*** | (2006.01) |
| *A63B 69/38* | (2006.01) |
| *A63B 65/00* | (2006.01) |
| *A63B 67/20* | (2006.01) |

(Continued)

(52) U.S. Cl.

CPC ..... *A63B 69/0002* (2013.01); *A63B 15/00* (2013.01); *A63B 21/00043* (2013.01); *A63B 21/023* (2013.01); *A63B 21/4035* (2015.10); *A63B 23/03516* (2013.01); *A63B 23/14* (2013.01); *A63B 23/16* (2013.01); *A63B 65/00* (2013.01); *A63B 67/20* (2013.01); *A63B 69/0059* (2013.01); *A63B 69/0079* (2013.01); *A63B 69/38* (2013.01); *A63B 2069/0004* (2013.01); *A63B 2069/0006* (2013.01); *A63B 2069/0008* (2013.01); *A63B 2208/12* (2013.01)

(58) Field of Classification Search

CPC ..... A63B 69/0002; A63B 69/0091; A63B 15/00; A63B 69/0088; A63B 69/00; A63B 21/0004; A63B 21/00043

USPC ..... 473/422, 457, 437, 256

See application file for complete search history.

(56) References Cited

U.S. PATENT DOCUMENTS 1,638,003 A * 8/1927 Neumann ..... A63B 21/0004 482/126
1,865,173 A * 6/1932 Dickerman ..... F41J 9/28 124/5
2,765,170 A * 10/1956 Brown ..... A63B 69/0091 473/424

(Continued)

*Primary Examiner* — Mitra Aryanpour
(74) *Attorney, Agent, or Firm* — McHale & Slavin, P.A.

(57) ABSTRACT

The invention involves a device for training individuals a proper striking and throwing technique, through simulation, to increase the accuracy and consistency of strikes and pitches, as well as to strengthen muscles through resistance training in order to increase stamina and to reduce muscle fatigue and risk of injury. The system includes a sphere in the form of a game ball secured to each distal end of a resilient member so that a trainee may grip one of the spheres or handle in a desired manner to utilize his/her grip and snap the wrist in a desired manner to work the forearm and hand muscles associated with a proper release of the ball for a desired pitch or proper strike of the game object. The dynamic action provided by the resilient member provides strengthening and muscle memory which can be repeated in a game situation.

14 Claims, 12 Drawing Sheets

(51) Int. Cl.
*A63B 23/14* (2006.01)
*A63B 23/16* (2006.01)

(56) References Cited

U.S. PATENT DOCUMENTS 3,334,899 A * 8/1967 Bosko ..... A63B 21/0602 482/108
3,451,675 A * 6/1969 Burzenski ..... A63B 21/00043 482/126
3,807,730 A * 4/1974 Dalton ..... A63B 21/0004 482/126
4,513,965 A * 4/1985 Aschermann ..... A63B 69/0002 473/458
4,555,111 A * 11/1985 Alvarez ..... A63B 69/0002 473/457
4,784,386 A * 11/1988 Muehl ..... A63B 23/16 482/122
4,856,776 A * 8/1989 Ching-Liang ..... A63B 21/045 482/122
5,215,307 A * 6/1993 Huffman ..... A63B 15/00 473/457
5,514,058 A * 5/1996 Buoni ..... A63B 21/0004 482/124
5,599,021 A * 2/1997 Lary ..... A63B 15/00 473/558
5,720,700 A * 2/1998 Buoni ..... A63B 21/0004 482/124
6,241,629 B1 * 6/2001 Otto ..... A63B 69/0002 473/457
6,837,808 B1 * 1/2005 Hatch ..... A63B 69/0088 473/424
7,235,024 B2 * 6/2007 Lefebvre ..... A63B 15/00 473/457
8,771,106 B1 * 7/2014 Boulanger ..... A63B 43/007 473/422
8,900,075 B2 * 12/2014 Gu ..... A63B 69/0002 473/422
2006/0094573 A1 * 5/2006 Weck ..... A63B 21/0004 482/126
2010/0120591 A1 * 5/2010 Shaterian ..... A61H 15/0092 482/106
2010/0130313 A1 * 5/2010 Bastian ..... A63B 15/00 473/457
2012/0316012 A1 * 12/2012 Thackeray ..... A63B 15/00 473/457
2015/0018132 A1 * 1/2015 Lovelace ..... A63B 69/0002 473/458
2015/0119172 A1 * 4/2015 Long ..... A63B 69/0002 473/457

* cited by examiner

TRAINING DEVICE

RELATED APPLICATIONS

In accordance with 37 C.F.R 1.76, a claim of priority is included in an Application Data Sheet filed concurrently herewith. Accordingly, the present invention claims priority to U.S. Provisional Patent Application No. 61/844,093, filed Jul. 9, 2013, entitled, "Training Device", and claims priority to U.S. Provisional Patent Application No. 61/885,846, filed Oct. 2, 2013, entitled, "Training Device". The contents of each of the above referenced applications are herein incorporated by reference in its entirety.

FIELD OF INVENTION

The invention relates to the field of pitching, striking and throwing devices for use in training for sports such as baseball, softball, football, racquetball, golf, hockey, lacrosse and tennis and the like, with a dual purpose for teaching proper technique, while also developing motor memory and strengthening muscles through resistance training for activities that use the forearm, wrist and hand.

BACKGROUND INFORMATION

Games in which a player throws a ball, or strikes an object such as baseball, football, softball, racquetball, golf, hockey, lacrosse and tennis that are popular with both children and adults. Training devices are useful for beginners, such as children, who want to learn the basics of proper throwing technique, as well for experienced players, such as teenagers, adults or even professionals, who want to improve or hone their skills.

The theory of sports training is to build correct muscle memory during training that will translate into correct muscle movement during an athletic event. Correct muscle movement during an athletic event is expected to produce a desired performance during the athletic event. Incorrect form during training builds incorrect muscle memory and will result in poorer performance during an athletic event.

It is important to accurately simulate the freedom of movement necessary for training proper throwing or striking technique. Resistance training devices are also useful, since strengthened muscles improve the player's stamina and allow for longer playing time. Also, strong muscles decrease the potential for injury. When a player is injured, they may not be able to continue playing the game. This is not only a disappointment for the player, but the team may suffer by losing its competitive advantage.

Sports training for pitching and throwing consists of repetitive cycles of pitching and throwing. A typical pitcher will grip and throw the ball 100 times per game. He/she must exert the proper velocity to the ball while imparting spin to the ball for delivering the desired pitch. Training must be observed and corrected as needed to insure that the correct muscle memory is being created. Current training methods today generally require an outside observer (a trainer or coach) to observe and correct form during training to produce desired muscle memory. Training sessions need to be long to insure that muscle memory is being developed by consistency, which can only be developed by a large number of correctly performed repetitions.

When hands and eyes are used for exercise, the eyes direct the movement of the hands to the target. The eyes provide initial information regarding the target including size, shape and velocity. Continued visual input is used to adjust for errors in movement to create a more precise movement to the object. Thus, training for striking an object with an elongated sporting implement typically requires repetitive cycles of viewing the object to be struck, which may include a trajectory, and striking the desired object to build eye hand coordination. Training must be observed and corrected as needed to insure that the correct muscle memory is being created. Current training methods today generally require an outside observer (a trainer or coach) to observe and correct form during training to produce desired muscle memory. Training sessions need to be long to insure that muscle memory is being developed by consistency, which can only be developed by a large number of correctly performed repetitions.

Very few training devices exist to aid in the development of correct muscle memory. Most existing training devices are geared toward building muscle mass. Some existing devices are large, heavy and bulky and do not lend themselves to portability. Most existing training devices require an extensive amount of time to train because rapid repetitive motion is not allowed. Most existing technologies cannot be performed without the aid of one or more additional individuals which requires an individual to schedule training around other people's schedules. Often, a coach is necessary to insure proper and correct muscle memory is being built.

Therefore, there is a need for an apparatus which would teach both children and adults of both genders proper technique, through simulation, to increase the accuracy and consistency of throwing pitches, or striking a game object, such as a ball, puck or bird as well as to strengthen muscles through resistance training in order to increase stamina, and to reduce muscle fatigue and risk of injury. The training device should be portable and suitable for use alone or with the assistance of a coach or trainer.

Thus, the present invention provides a training device which overcomes the disadvantages of prior art training systems. The training system of the present invention not only provides for relative ease in the assembly and use, it also permits training without the need to be supervised by a coach or trainer.

SUMMARY OF THE INVENTION

Briefly, the invention involves a device and method for training both children and adults of both genders proper throwing technique, through simulation, to increase the accuracy and consistency, as well as to strengthen muscles through resistance training in order to increase stamina, and to reduce muscle fatigue and risk of injury. The system includes a game object in the form of a ball, puck, bird or the like secured to one end of a resilient member and a hand grip secured to the opposite distal end of the resilient member so that a trainee may grip the hand grip in a desired manner to utilize his/her grip and snap the wrist in a desired manner to work the forearm and hand muscles associated with a proper throw or strike of the ball. The dynamic action provided by the resilient member provides strengthening and muscle memory which can be repeated in a game situation. Once the action of the resilient member has subsided, the device is automatically reset for the next grip and snap of the wrist or arms.

Accordingly, it is an objective of the present invention to provide a pitching/throwing training device.

It is a further objective of the present invention to provide a pitching training device that provides pitching technique utilizing a real game ball.

It is yet a further objective of the present invention to provide a pitching training device that provides resistance training for increased muscle building.

It is another objective of the instant invention to provide a pitching training device that provides muscle memory for pitching.

It is still another objective of the present invention to provide a training device for pitching that is suitable to simulate the different styles of pitches, such as straight ball, curve ball, fast ball, change up, slider, and knuckle ball, among others.

It is yet another objective of the present invention to provide a training device for a game that includes striking a game object.

It is yet a further objective of the present invention to provide a training device that provides striking technique utilizing a real game ball, puck or bird.

Still yet a further objective of the present invention is to provide a training device that provides resistance training for increased muscle building.

Still yet a further objective of the instant invention to provide a training device that provides muscle memory for striking a game object.

An even further objective of the present invention is to provide a training device for striking that is suitable to simulate the different styles of strikes, such as golf, baseball, racquetball, tennis, hockey, and badminton, among others.

Other objectives and advantages of this invention will become apparent from the following description taken in conjunction with the accompanying drawings wherein are set forth, by way of illustration and example, certain embodiments of this invention. The drawings constitute a part of this specification and include exemplary embodiments of the present invention and illustrate various objects and features thereof.

DETAILED DESCRIPTION OF THE PREFERRED EMBODIMENTS

Figure 1:
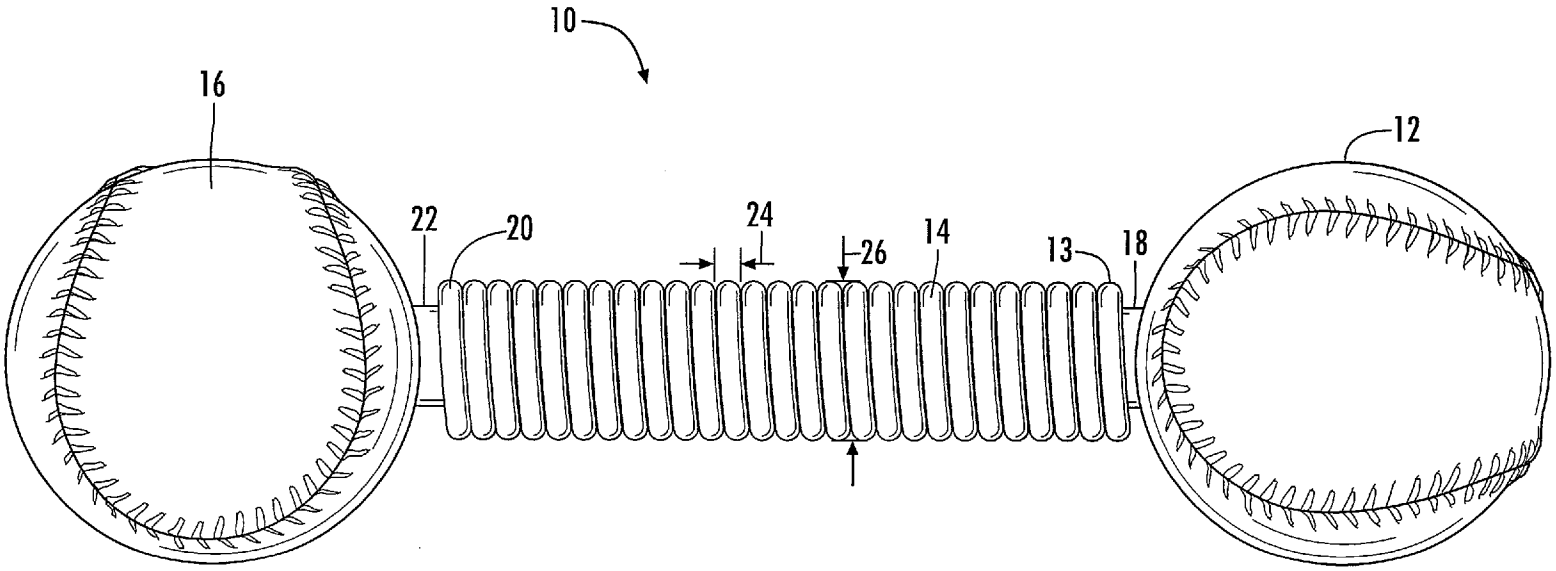
FIG. 1 is a side view of one embodiment of the present invention.

While the present invention is susceptible of embodiment in various forms, there is shown in the drawings and will hereinafter be described a presently preferred embodiment with the understanding that the present disclosure is to be considered an exemplification of the invention and is not intended to limit the invention to the specific embodiments illustrated.

Referring generally to FIGS. 1-5, a training device 10 for pitching is illustrated. The training device 10 generally includes at least one first spherical member 12, a resilient member or assembly 14 and a weight or a second spherical member 16. The first spherical member 12 is secured to the first distal end 13 of the resilient member 14 via a first fastener 18. In a preferred embodiment, the spherical member(s) is/are illustrated herein as baseball(s). However, it should be noted that other spherical members such as softballs or the like may be secured to the end of the resilient member without departing from the scope of the invention. In a preferred embodiment, the spherical members 12, 16 respectively are secured to the resilient member 14 in a fixed arrangement but in a manner that allows the spherical members 12, 16 respectively to be reoriented to allow pitchers to practice various grip positions on the spherical members. This construction also allows the baseballs to be replaced with other spherical members such as, but not limited to, softballs, professional baseballs or the like to allow the user to practice more than one sport or more than one level of a particular sport. The resilient member 14 is preferably constructed as a coil spring of a predetermined length, the distal ends 13, 20 of which are secured to the first and second spherical members 12, 16 via fasteners 18, 22 respectively. The diameter of the wire 24 used to construct the coils of the resilient member 14, as well as the coil diameter 26 of the coils, may be varied to alter the characteristics of the resilient members flexing characteristics during operation. In a preferred embodiment, the coil diameter 26 is about one inch in diameter and the wire diameter of the spring is about one eighth of an inch in diameter. The preferred material for construction of the resilient member is spring temper steel; however, it should be noted that other materials may be utilized without departing from the scope of the invention. It should also be noted that resilient members constructed from materials other than coil springs, or in combination with coil springs, may be utilized without departing from the scope of the invention. Such materials may be monolithic or they may be constructed from various materials in a layered arrangement to provide a resilient spring type action.

Figure 2:
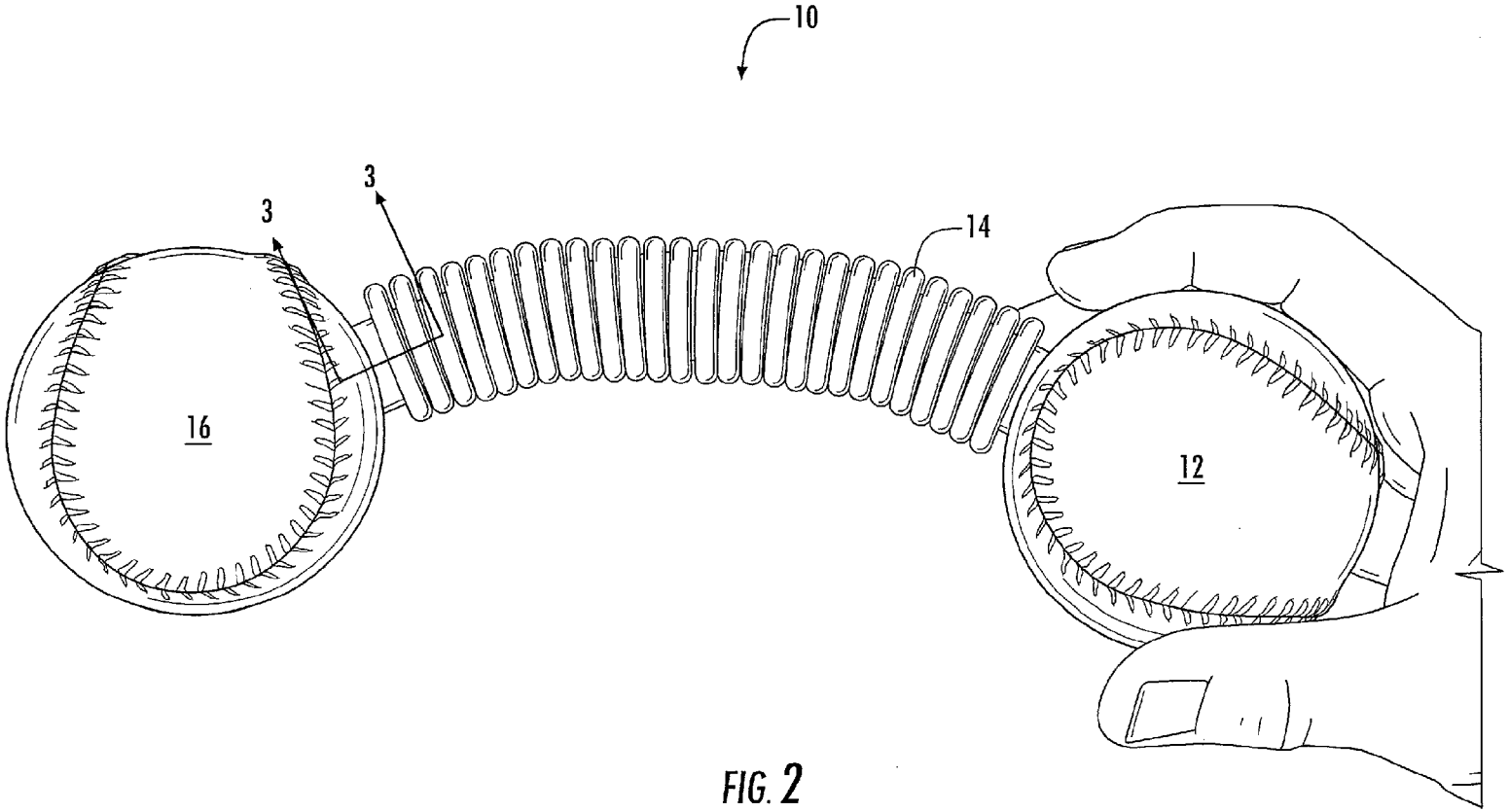
FIG. 2 is a side view of the embodiment shown in FIG. 1 illustrating the device in use.

Referring to FIG. 2, the training device is illustrated in operation. In operation, the user grips one or the other of the spherical members 12, 16. As illustrated, the first spherical member 12 is fixed in a first orientation while the second spherical member 16 is oriented in a second fixed orientation. This construction allows the user to practice different ball grips which will provide different ball action in a game situation. Once the user grips the ball, he/she snaps the wrist repeatedly as they would with a proper release of the ball for a desired pitch or throw, causing the second spherical member 16 to bend the resilient member 14 which puts a rotational torque on the gripped ball. The rotational torque strengthens the hand, wrist and forearm muscles of the user while building muscle memory for the motion. The characteristics of the resilient member cause it to automatically return to its original shape whereby it is ready for the next wrist snap. It should also be noted that while spherical members 12, 16 respectively are illustrated on both ends of the present training device, one of the spheres may be replaced with a weight which may be static or dynamic in nature without departing from the scope of the invention. The weights may be interchangeable to allow the user to adjust the training device to his or her level of ability.

Figure 3:
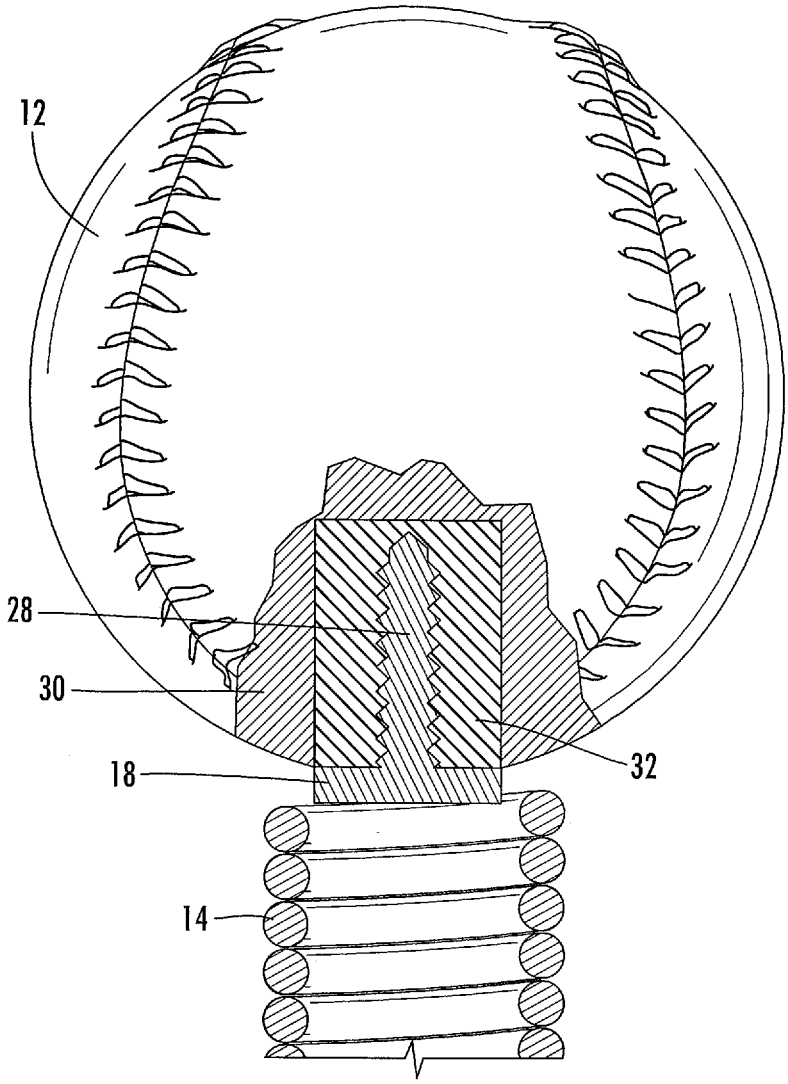
FIG. 3 is a partial side view of the embodiment shown in FIG. 2 taken along lines 3-3, illustrating assembly of the resilient member to the spherical member.

Referring to FIG. 3, a partial cross section taken along lines 3-3 of FIG. 2 is illustrated. This figure illustrates one embodiment of the securement between the resilient member 14 and the spherical members 12 16 respectively using a fastener 18. The fastener 18 is secured to the resilient member 14 by a well-known method such as welding, brazing, soldering or the like and includes a threaded portion 28 for cooperation with an internal portion 30 of the spherical member. The fastener 18 is preferably a threaded fastener however, non-threaded fasteners having groves twists or other configurations suitable for securement to the inner portion of the sphere may be utilized without departing from the scope of the invention. In at least one embodiment, an insert 32 may be provided in the spherical member for threaded cooperation with the fastener. In other embodiments (not shown), the resilient member 14 may be directly connected to the spherical member without departing from the scope of the invention. In these arrangements, adhesives, epoxies or the like may be used in place of or in conjunction with the fastener(s).

Figure 4A:
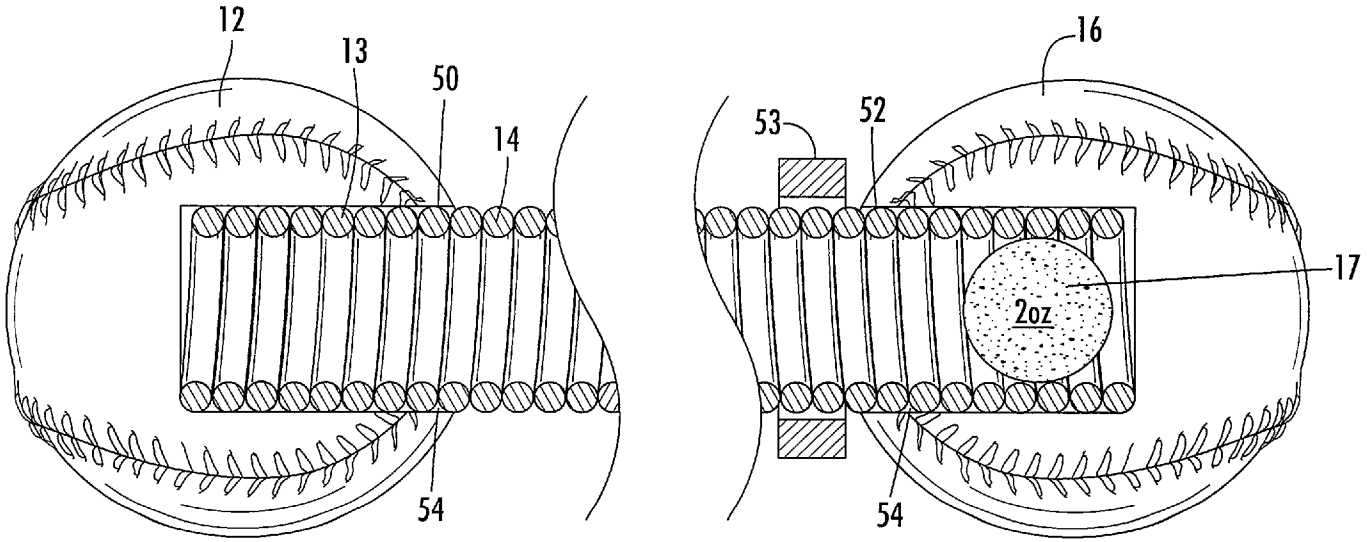
FIG. 4A is a side view partially in section illustrating an alternative embodiment of the present invention.
Figure 4B:
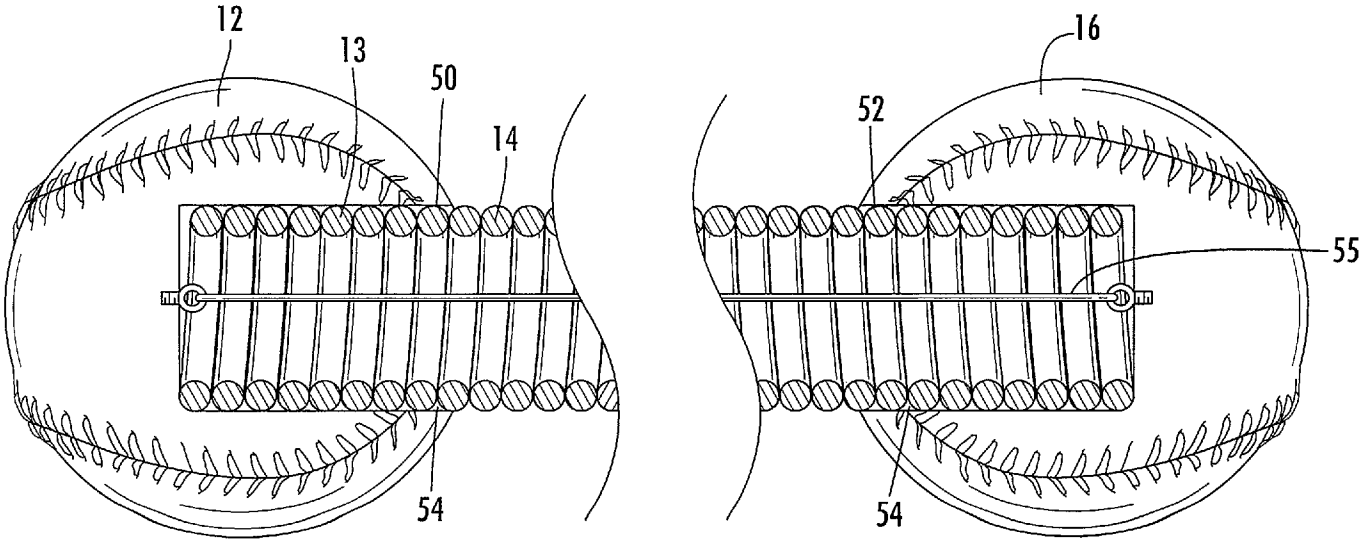
FIG. 4B is a side view partially in section illustrating an alternative embodiment of the present invention.

Referring to FIG. 4, an alternative embodiment of the present invention is illustrated. This embodiment of the training device 10 generally includes at least one first spherical member 12, a resilient member or assembly 14 and a second spherical member 16 which may include a weight 17. The first spherical member 12 includes a bore 50 sized to accept the resilient member 14. In a most preferred embodiment, the bore extends about halfway through the spherical member 12 and epoxy, adhesive or the like is positioned between the spherical member and the resilient member to secure the two together. The second spherical member 16 also includes a bore 52 sized to accept the resilient member 14. Epoxy, adhesive or the like 54 is then utilized to the secure the two members together. A weight 17 may be positioned in or around the resilient member or within the spherical member for added resistance. The weight(s) 17 may vary in size based on the level of the user but in a most preferred embodiment range from about zero ounces for youth, two ounces for minor league players and 3 three ounces for major league players. The weights may be permanently affixed within the resilient member or they may be interchangeable to allow customization to a player's ability. In yet another alternative embodiment, the weight may be allowed to float back and forth within the resilient member during the operative action of the exercise device. In a preferred embodiment, the spherical member(s) is/are illustrated herein as baseball(s). However, it should be noted that other spherical members such as softballs or the like may be secured to the end of the resilient member without departing from the scope of the invention. In a preferred embodiment, the spherical members are secured to the resilient member in a fixed arrangement but in a manner that allows the spherical members to be reoriented to allow pitchers to practice various grip positions on the spherical members. This construction also allows the baseballs to be replaced with other spherical members that are thrown such as, but not limited to, softballs, footballs or the like to allow the user to practice more than one sport or more than one level of a particular sport. The resilient member 14 is preferably constructed as a coil spring of a predetermined length, the distal ends 13, 20 of which are secured to the first and second spherical members 12, 16 via bores 50, 52 respectively. The diameter of the wire 24 used to construct the coils of the resilient member 14, as well as the diameter 26 of the coils, may be varied to alter the characteristics of the resilient members flexing characteristics during operation. In a preferred embodiment, the coil diameter 26 is about one inch in diameter and the wire diameter 24 of the spring is about one eighth of an inch in diameter. The preferred material for construction of the resilient member 14 is spring temper steel; however, it should be noted that other materials may be utilized without departing from the scope of the invention. It should also be noted that resilient members constructed from materials other than coil springs, or in combination with coil springs, may be utilized without departing from the scope of the invention. Such materials may be monolithic or they may be constructed from various materials in a layered arrangement to provide a resilient spring type action.

Figure 5:
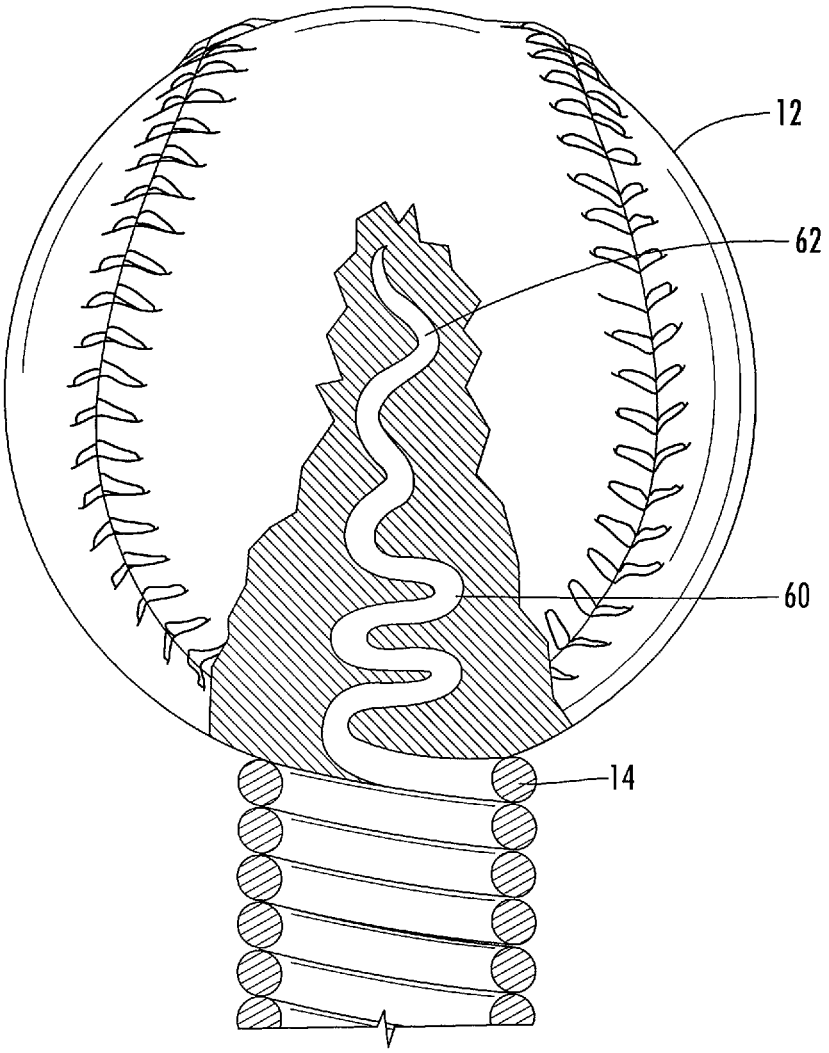
FIG. 5 is a side view partially in section illustrating an alternative embodiment of the present invention.
Figure 6:
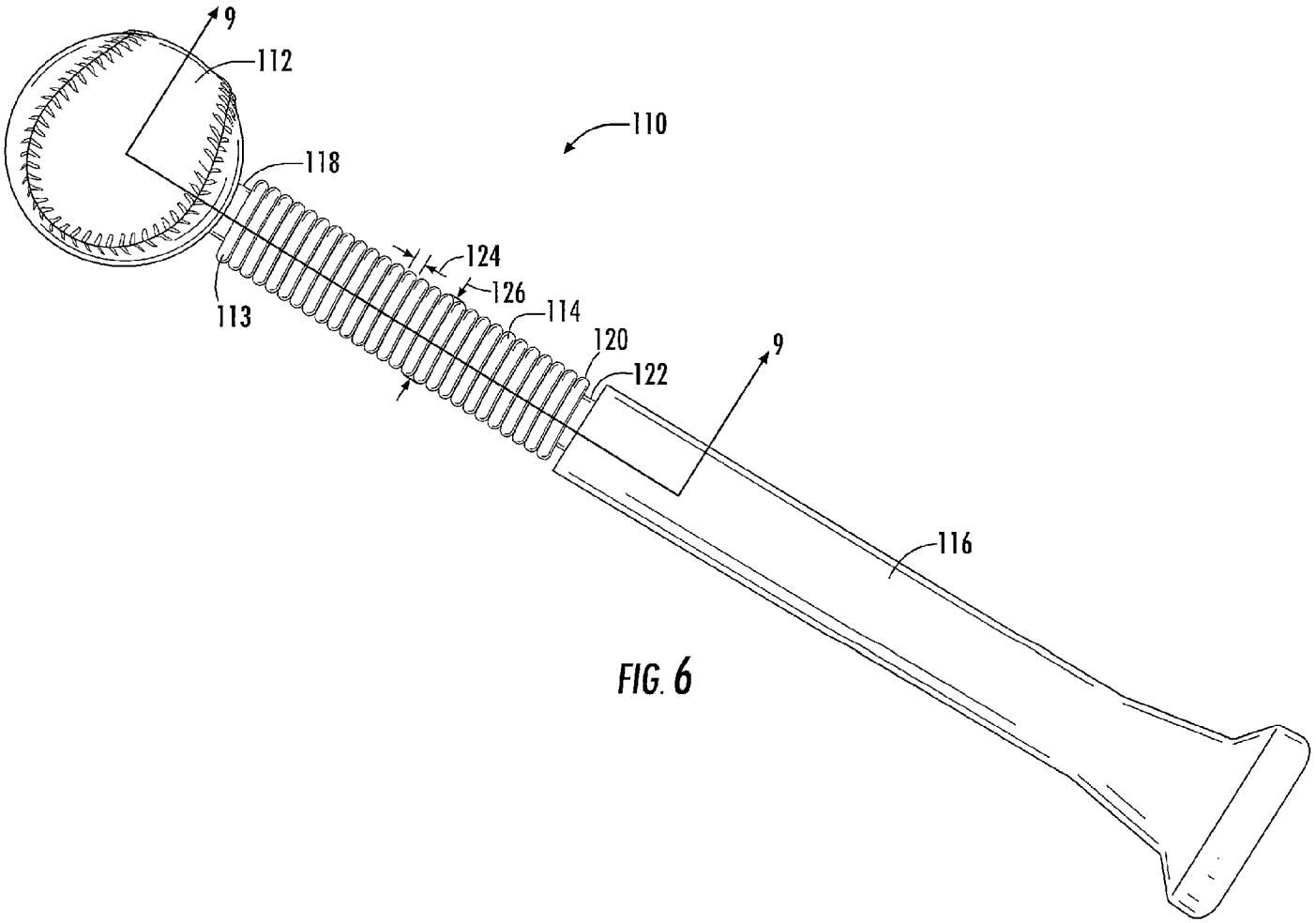
FIG. 6 is a side view of one embodiment of the present invention.

Referring to FIG. 5, a partial cross section taken along lines 3-3 of FIG. 2 is illustrated. This figure illustrates one embodiment of the securement between the resilient member and the spherical members using a fastener 18 formed from a portion of the resilient member 14. The fastener 18 is formed from a portion of resilient member in the form of a coil spring wherein the distal end 60 of the spring is stretched and/or formed into a corkscrew threaded portion 62 for cooperation with an internal portion 30 of the spherical member. The corkscrew threaded portion 62 is preferably a decreasing pitch thread however, other formed shapes having twists or other configurations suitable for securement to the inner portion of the sphere may be utilized without departing from the scope of the invention. In the preferred embodiment, the resilient member may be directly connected to the spherical member. In other embodiments, adhesives, epoxies or the like may be used in place of or in conjunction with the fastener(s).

Referring generally to FIGS. 6-11, a training device 110 for striking a game ball or object is illustrated. The training device 110 generally includes at least one game member or ball 112, a resilient member or assembly 114 and a handle member 116. The first game member 112 is secured to the first end 113 of the resilient member 114 via a first fastener 118. In a preferred embodiment, the game member(s) is/are illustrated herein as baseball(s). However, it should be noted that other game members such as softballs, tennis balls, shuttlecocks, hockey pucks (FIG. 6), racquetballs, lacrosse balls or the like may be secured to the end of the resilient member 114 without departing from the scope of the invention. In a preferred embodiment, the game members 112 are secured to the resilient member 114 in a fixed arrangement while the handle member 116 is secured to the second end 120 of the resilient member in a manner that allows the user to practice various grip positions and swing trajectories. This construction also allows the game member 112 to be replaced with other game members such as, but not limited to, tennis balls, shuttlecocks, hockey pucks (FIG. 11), racquetballs, lacrosse balls or the like to allow the user to practice more than one sport or more than one level of a particular sport with a single device. The resilient member 114 is preferably constructed as a coil spring of a predetermined length, the distal ends 113, 120 of which are secured to the game member 112 and handle member 116 via fasteners 118, 122 respectively. The diameter of the wire 124 used to construct the coils of the resilient member 114, as well as the coil diameter 126 of the coils, may be varied to alter the resilient members flexing characteristics during operation. In a preferred embodiment, the coil diameter 126 is about one inch in diameter and the wire diameter 124 of the spring is about one eighth of an inch in diameter. The preferred material for construction of the resilient member is spring temper steel; however, it should be noted that other materials may be utilized without departing from the scope of the invention. It should also be noted that resilient members constructed from materials other than coil springs, or in combination with coil springs, may be utilized without departing from the scope of the invention. Such materials may be monolithic or they may be constructed from various materials in a layered arrangement to provide a resilient spring type action. In at least one embodiment, a cable member extends through the resilient member and is secured to both the game member and the handle member to provide a safety mechanism in the event that a portion of the training device catastrophically fails. In this manner, loose components of the device are retained from flying away from the training device.

Figure 7:
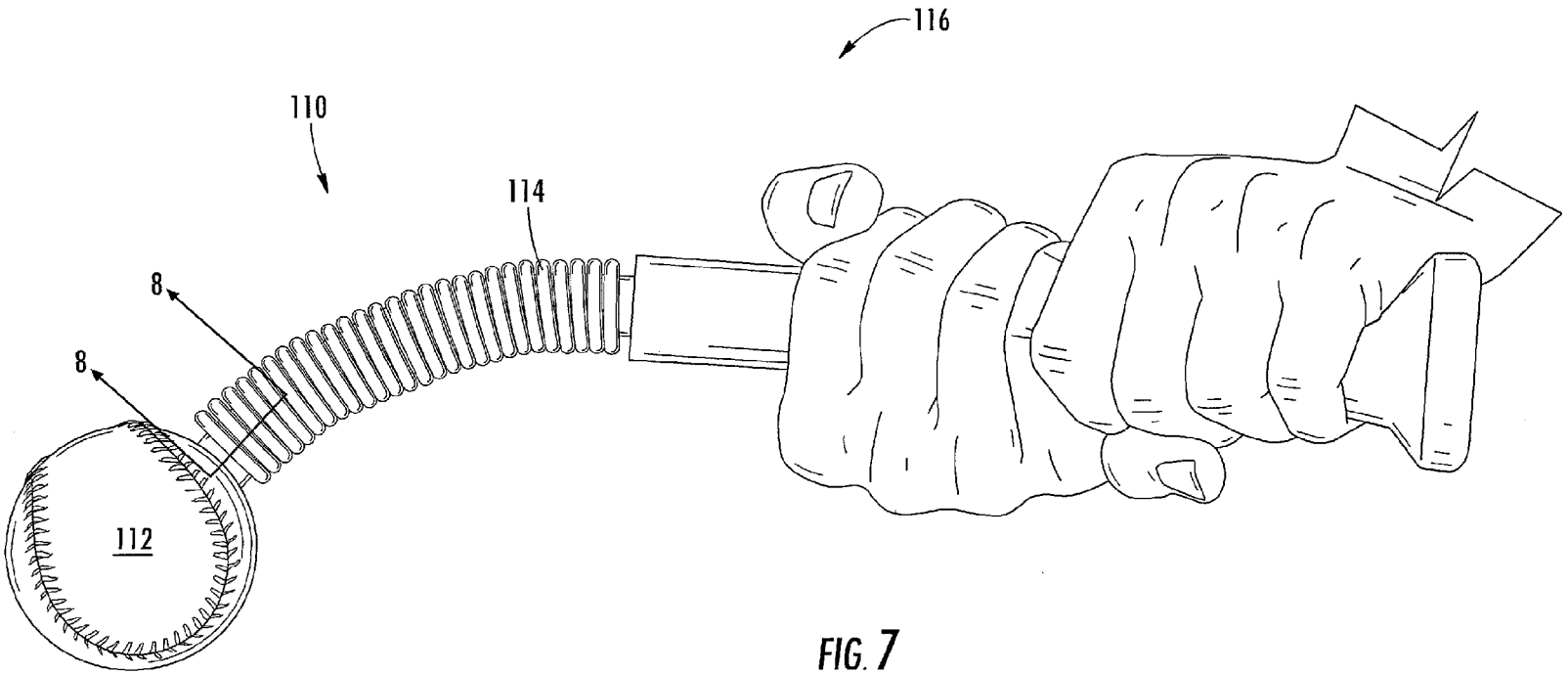
FIG. 7 is a side view of the embodiment shown in FIG. 6 illustrating the device in use.

Referring to FIG. 7, the training device is illustrated in operation. In operation, the user grips the handle member 116. As illustrated, the game member 112 is fixed in a first orientation while the handle member 116 is oriented in a second fixed orientation. This construction allows the user to practice different grips on the handle member which will provide different game member action in a game situation. Once the user grips the handle, he/she snaps the wrist repeatedly as they would with a proper strike of the game member for a desired trajectory and velocity, causing the game member to bend the resilient member which puts a rotational torque on the gripped handle. The rotational torque strengthens the hand, wrist and forearm muscles of the user while building muscle memory for the motion while the visualization of the game member provides hand eye coordination of having the game member in the proper position for making the strike. The characteristics of the resilient member cause it to automatically return to its original shape whereby it is ready for the next wrist snap. It should also be noted that while game members are illustrated on the first end of the present training device, the game member may be replaced with a weight which may be static or dynamic in nature without departing from the scope of the invention. The weights may be interchangeable to allow the user to adjust the training device to his or her level of ability.

Figure 8:
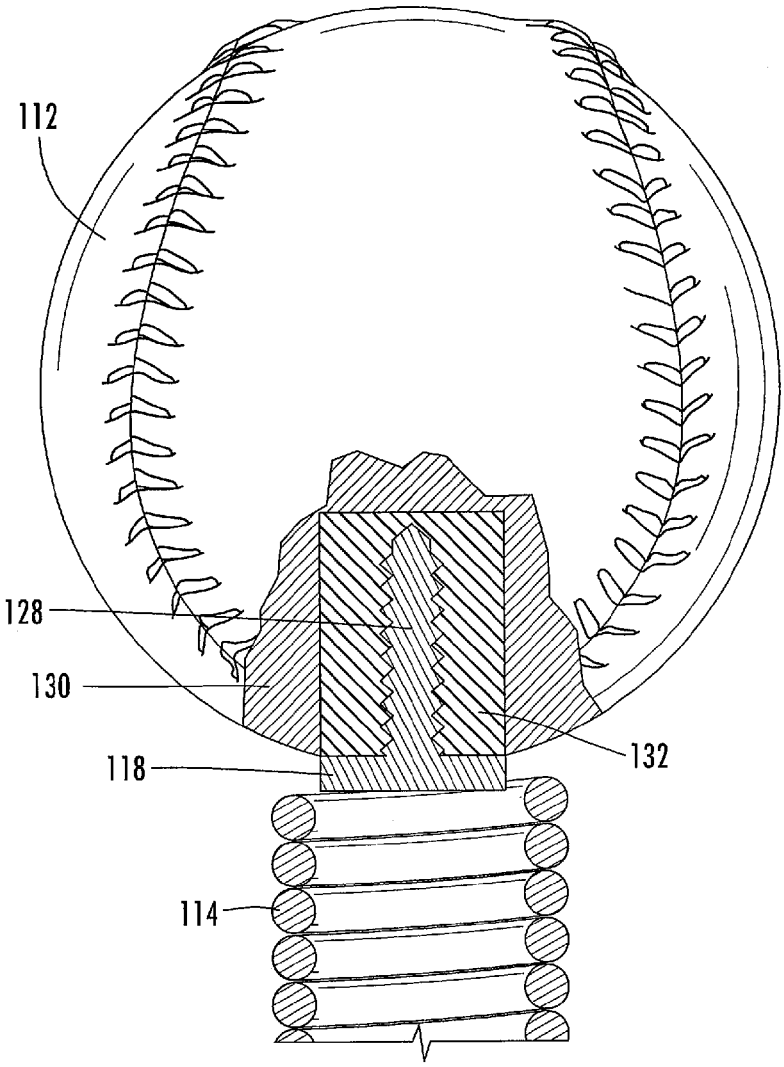
FIG. 8 is a partial side view of the embodiment shown in FIG. 7 taken along lines 8-8, illustrating assembly of the resilient member to the spherical member.

Referring to FIG. 8, a partial cross section taken along lines 8-8 of FIG. 7 is illustrated. This figure illustrates one embodiment of the securement between the resilient member and the game member, illustrated herein as a baseball, using a fastener 118. The fastener 118 is secured to the resilient member by a well-known method such as welding, brazing, soldering or the like, and includes a threaded portion 128 for cooperation with an internal portion 130 of the game member. The fastener is preferably a threaded fastener, however, non-threaded fasteners having grooves, twists or other configurations suitable for securement to the inner portion of the sphere may be utilized without departing from the scope of the invention. In at least one embodiment, an insert 132 may be provided in the spherical member for threaded cooperation with the fastener. In other embodiments (not shown), the resilient member may be directly connected to the spherical member without departing from the scope of the invention. In these arrangements, adhesives, epoxies or the like may be used in place of or in conjunction with the fastener(s).

Figure 9:
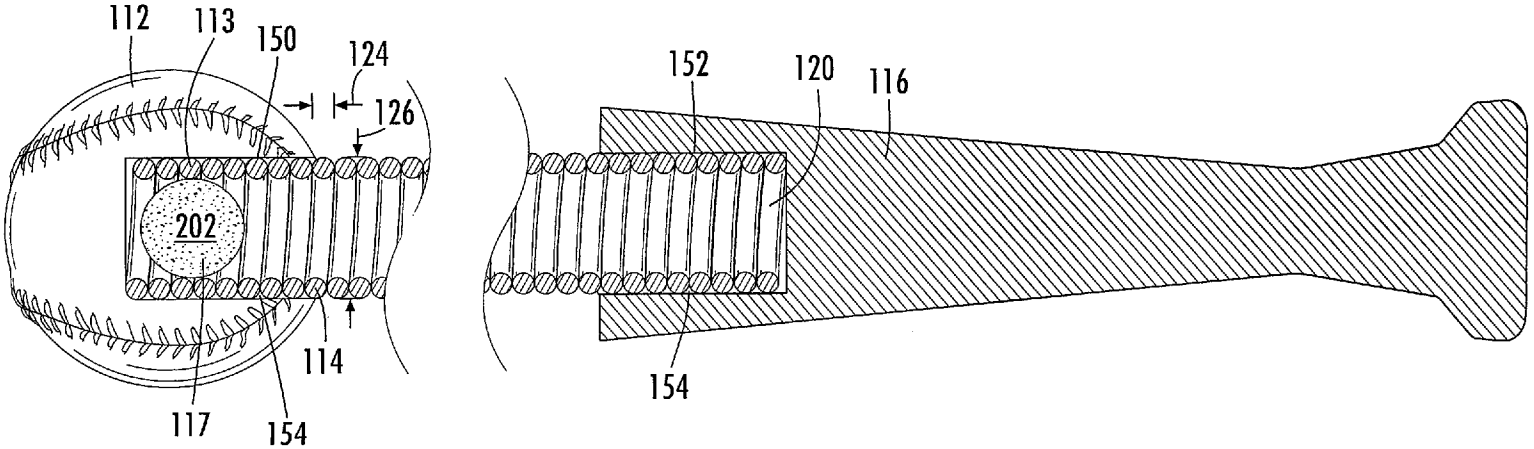
FIG. 9 is a side view taken along lines 9-9 of FIG. 6 illustrating an alternative embodiment of the present invention.

Referring to FIG. 9, an alternative embodiment of the present invention is illustrated. This embodiment of the training device 110 generally includes at least one first game member 112 which may include a weight 117, a resilient member or assembly 114 and a handle member 116. The game member 112 includes a bore 150 sized to accept the resilient member 114. In a most preferred embodiment, the bore extends about halfway through the game member 112 and epoxy, adhesive or the like 154 is positioned between the spherical member and the resilient member to secure the two together. The handle member 116 also includes a bore 152 sized to accept the resilient member 114. Epoxy, adhesive or the like 154 is then utilized to the secure the two members together. A weight 117 may be positioned in or around the resilient member or within the game member for added resistance. The weight(s) 117 may vary in size based on the level of the user, but in a most preferred embodiment range from about five ounces for youth, eight ounces for amateur players and ten ounces for professional players. The weights may be permanently affixed within the resilient member or they may be interchangeable to allow customization to a player's ability. In yet another alternative embodiment, the weight may be allowed to float back and forth within the resilient member during the operative action of the exercise device. In a preferred embodiment, the game member(s) is/are illustrated herein as baseball(s). However, it should be noted that other game members such as softballs, hockey pucks or the like may be secured to the end of the resilient member without departing from the scope of the invention. In a preferred embodiment, the game members are secured to the resilient member in a fixed arrangement but in a manner that allows the game members to be reoriented to allow athletes to practice various striking positions on the game members. This construction also allows the game member to be replaced with other game members that are struck in the course of an athletic event such as, but not limited to, softballs, hockey pucks, badminton birds, cricket balls, lacrosse balls or the like to allow the user to practice more than one sport or more than one level of a particular sport. The resilient member 114 is preferably constructed as a coil spring of a predetermined length, the distal ends 113, 120 of which are secured to the game member 112, and handle 116 via bores 150, 152 respectively. The diameter of the wire 124 used to construct the coils of the resilient member 114, as well as the diameter 126 of the coils, may be varied to alter the characteristics of the resilient members flexing characteristics during operation. In a preferred embodiment, the coil diameter 126 is about one inch in diameter and the wire diameter 124 of the spring is about one eighth of an inch in diameter. The preferred material for construction of the resilient member is spring temper steel; however, it should be noted that other materials may be utilized without departing from the scope of the invention. It should also be noted that resilient members constructed from materials other than coil springs, or in combination with coil springs, may be utilized without departing from the scope of the invention. Such materials may be monolithic or they may be constructed from various materials in a layered arrangement to provide a resilient spring type action.

Figure 10:
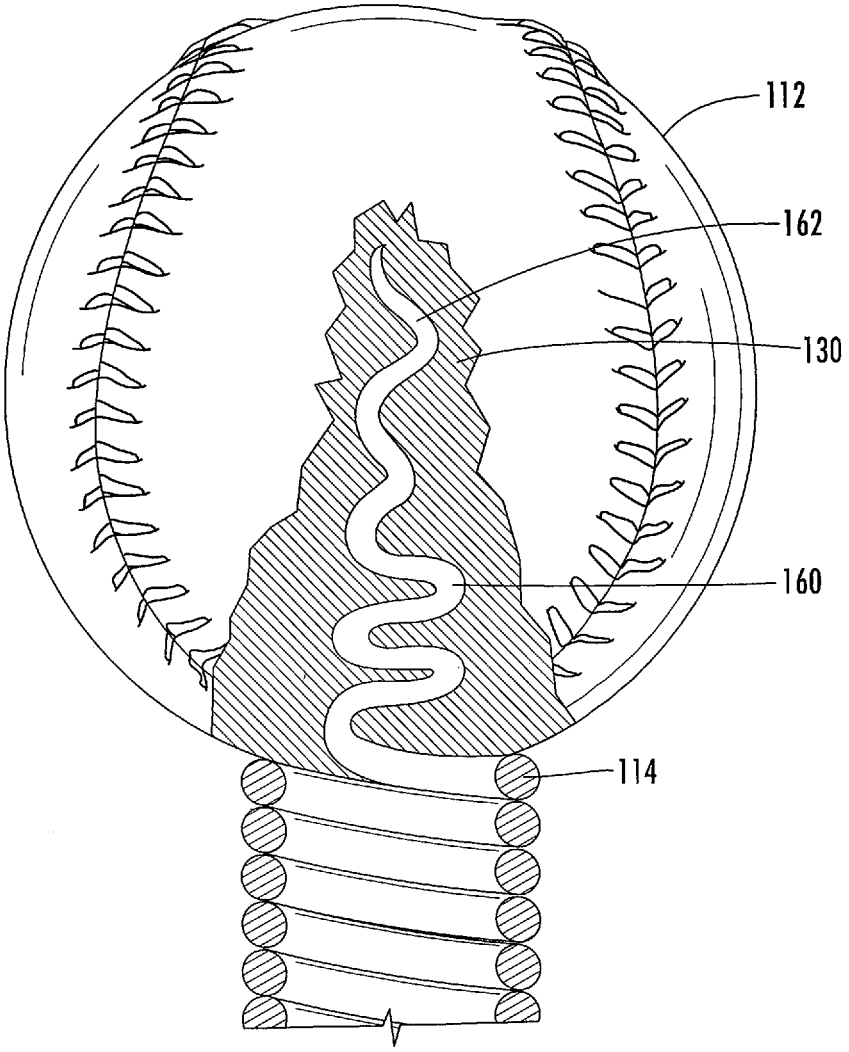
FIG. 10 is a side view partially in section illustrating an alternative embodiment of the present invention.

Referring to FIG. 10, a partial cross section taken along lines 3-3 of FIG. 2 is illustrated. This figure illustrates one embodiment of the securement between the resilient member and the game members using a fastener 118 formed from a portion of the resilient member 114. The fastener 118 is formed from a portion of resilient member in the form of a coil spring wherein the distal end 160 of the spring is stretched and/or formed into a corkscrew threaded portion 162 for cooperation with an internal portion 130 of the game member. The corkscrew threaded portion 162 is preferably a decreasing pitch thread; however, other formed shapes having twists or other configurations suitable for securement to the inner portion of the sphere may be utilized without departing from the scope of the invention. In the preferred embodiment, the resilient member may be directly connected to the spherical member. In other embodiments, adhesives, epoxies or the like may be used in place of or in conjunction with the fastener(s).

Figure 11:
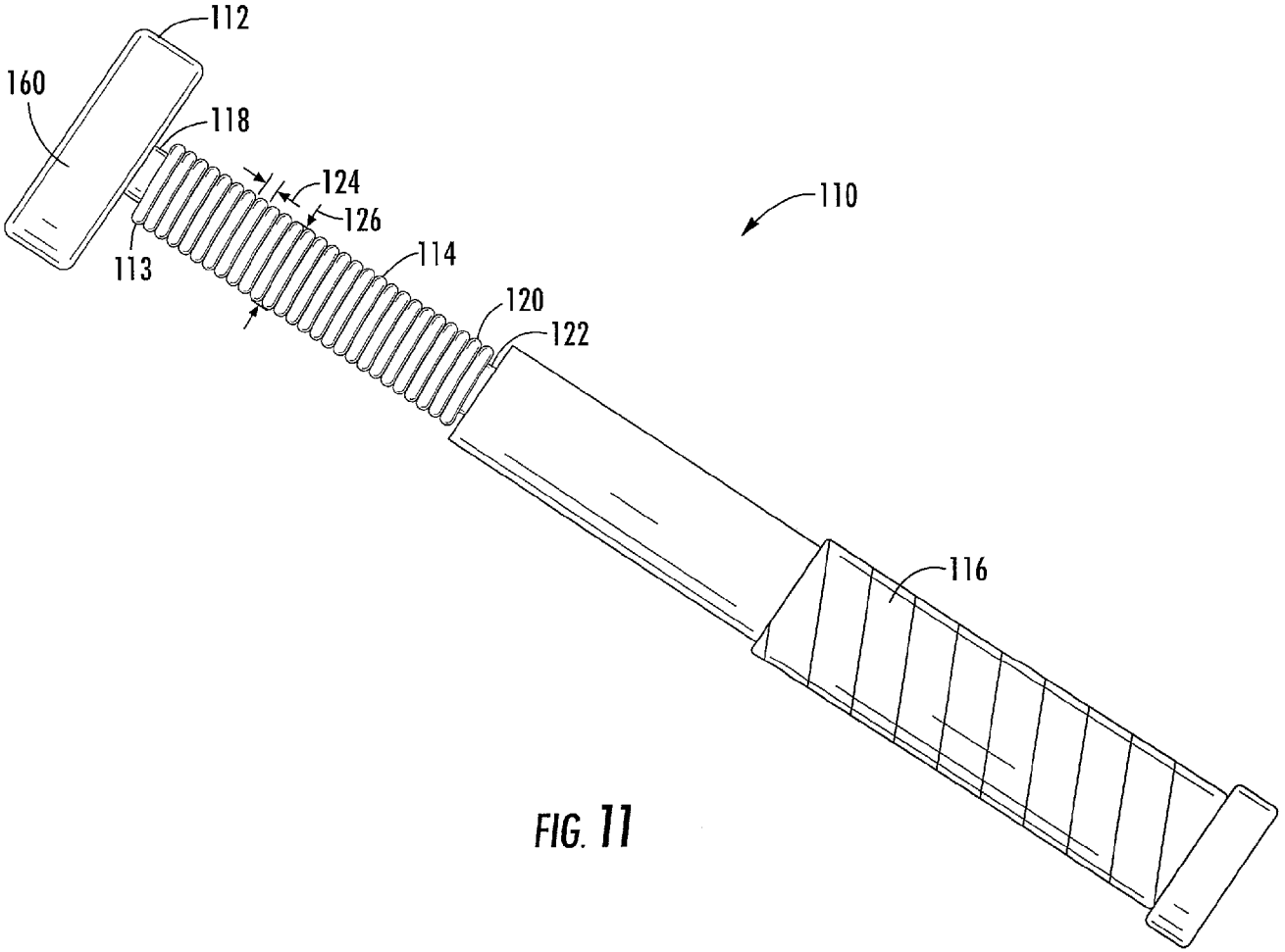
FIG. 11 is a side view partially in section illustrating an alternative embodiment of the present invention.

FIG. 11 illustrates an alternative embodiment of the present invention. In this embodiment, the game member 112 is a hockey puck 160 secured to a first end 113 of the resilient member 114 via a first fastener 118, and the handle is secured to the second end 120 of the resilient member with fastener 122. In a preferred embodiment, the game members are secured to the resilient member in a fixed arrangement while the handle member 116 is secured to the second end 120 of the resilient member in a manner that allows the user to practice various grip positions and swing trajectories. The resilient member 114 is preferably constructed as a coil spring of a predetermined length, the distal ends 113, 120 of which are secured to the game member 112 and handle member 116 via fasteners 118, 122 respectively. The diameter of the wire 124 used to construct the coils of the resilient member 114, as well as the diameter 126 of the coils, may be varied to alter the resilient members flexing characteristics during operation. In a preferred embodiment, the coil diameter 26 is about one inch in diameter and the wire diameter 24 of the spring is about one eighth of an inch in diameter. The preferred material for construction of the resilient member is spring temper steel; however, it should be noted that other materials may be utilized without departing from the scope of the invention. It should also be noted that resilient members constructed from materials other than coil springs, or in combination with coil springs, may be utilized without departing from the scope of the invention. Such materials may be monolithic, or they may be constructed from various materials in a layered arrangement to provide a resilient spring type action. In at least one embodiment, a cable member extends through the resilient member and is secured to both the game member and the handle member to provide a safety mechanism in the event that a portion of the training device catastrophically fails. In this manner, loose components of the device are retained from flying away from the training device.

All patents and publications mentioned in this specification are indicative of the levels of those skilled in the art to which the invention pertains.

It is to be understood that while a certain form of the invention is illustrated, it is not to be limited to the specific form or arrangement of parts herein described and shown. It will be apparent to those skilled in the art that various changes may be made without departing from the scope of the invention and the invention is not to be considered limited to what is shown and described in the specification.

One skilled in the art will readily appreciate that the present invention is well adapted to carry out the objects and obtain the ends and advantages mentioned, as well as those inherent therein. Any compounds, methods, procedures and techniques described herein are presently representative of the preferred embodiments, are intended to be exemplary and are not intended as limitations on the scope. Changes therein and other uses will occur to those skilled in the art which are encompassed within the spirit of the invention and are defined by the scope of the appended claims. Although the invention has been described in connection with specific preferred embodiments, it should be understood that the invention as claimed should not be unduly limited to such specific embodiments. Indeed, various modifications of the described modes for carrying out the invention which are obvious to those skilled in the art are intended to be within the scope of the following claims.

What is claimed is:

1. A training device for sports activities comprising:

a resilient member, said resilient member having a predetermined length, a first distal end and a second distal end;

a first spherical member secured to said first distal end via a first fastener member in a fixed arrangement;

a second spherical member secured to said second distal end via a second fastener member in a fixed arrangement;

whereby said fixed arrangement between said first and second spherical members and said resilient member is such that the resilient member and said second spherical member may be supported in a horizontal orientation when a user grips said first spherical member and completes a throwing motion of user's wrist, causing said resilient member to bend which applies a rotational torque on said first spherical member, said resilient member automatically resetting once said throwing motion is complete.

2. The training device for sports activities of claim 1 wherein said first fastener and said second fastener are formed from a portion of said resilient member.

3. The training device for sports activities of claim 1 wherein said resilient member is formed from spring temper steel.

4. The training device for sports activities of claim 3 wherein said resilient member is a coil spring.

5. The training device for sports activities of claim 4 wherein said coil spring includes a diameter, said diameter being about one inch.

6. The training device for sports activities of claim 4 wherein the wire of said coil spring is about one eighth of an inch in diameter.

7. The training device for sports activities of claim 1 wherein said first spherical member is fixedly oriented at a second fixed orientation with respect to said second spherical member.

8. The training device for sports activities of claim 1 including a cable member, said cable member extending along said resilient member and being secured to both said first spherical member and said second spherical member.

9. The training device for sports activities of claim 1 including a weight member secured about said resilient member.

10. The training device for sports activities of claim 1 wherein said resilient member includes a central bore extending therethrough, said central bore including a free weight member, said free weight member being free to travel the length of said central bore during operation of said training device.

11. The training device for sports activities of claim 10 wherein said first spherical member includes a bore extending at least partially through said first spherical member, said bore being sized to accept said resilient member, whereby said free weight member is free to travel the length of said central bore and said bore during operation of said training device.

12. The training device for sports activities of claim 1 wherein said first spherical member is a baseball.

13. A training device for sports activities comprising:

a resilient member, said resilient member having a predetermined length, a first distal end and a second distal end, said resilient member including a central bore extending therethrough, said central bore including a free weight member therein, said free weight member being fixed in position during operation of said training device;

a first spherical member secured to said first distal end via a first fastener member in a fixed arrangement;

a second spherical member secured to said second distal end via a second fastener member;

whereby a user grips said first spherical member such that said resilient member and said second spherical member are supported in a horizontal orientation and the user snaps his wrist repeatedly, causing said resilient member to bend which applies a rotational torque to said first spherical member, said resilient member automatically resetting once said throwing motion is complete.

14. The training device for sports activities of claim 13 wherein said first spherical member is a baseball.

* * * * *